United States Patent [19]

Raasch et al.

[11] Patent Number: 4,555,215

[45] Date of Patent: Nov. 26, 1985

[54] SPOOL TRANSPORTING DEVICE

[75] Inventors: Hans Raasch; Hans Grecksch, both of Monchen-Gladbach, Fed. Rep. of Germany

[73] Assignee: W. Schlafhorst & Co., Monchen-Gladbach, Fed. Rep. of Germany

[21] Appl. No.: 558,201

[22] Filed: Dec. 5, 1983

[30] Foreign Application Priority Data

Dec. 4, 1982 [DE] Fed. Rep. of Germany ..... 3244925

[51] Int. Cl.[4] ..... B65H 67/00

[52] U.S. Cl. ..... 414/564; 242/35.5 A; 294/88; 414/331; 414/346; 414/347; 414/398; 414/911

[58] Field of Search ..... 414/345, 347, 331, 567, 414/739, 911, 564, 346; 242/35.5 A; 294/88, 97, 115

[56] References Cited

U.S. PATENT DOCUMENTS

| | | | |
|---|---|---|---|
| 3,924,762 | 12/1975 | Igel | 414/331 |
| 4,138,072 | 2/1979 | Aoyama et al. | 242/35.5 A |
| 4,465,293 | 6/1984 | Panissidi | 294/88 X |

*Primary Examiner*—Robert G. Sheridan

*Attorney, Agent, or Firm*—Herbert L. Lerner; Laurence A. Greenberg; Adam A. Jorgensen

[57] ABSTRACT

A spool transporting assembly for the sequential transfer of textile spools wound on tubes, includes a spool preparation station having a support surface for textile spools, a spool receiving device, and a spool transporting device for transporting textile spools from the spool preparation station to the spool receiving device, the spool transporting device including a gripper head being movable in at least one plane into and out of a centered spool receiving position being fixed relative to the spool preparation station, the gripper head including gripper elements for gripping textile spools of different diameters in the centered spool receiving position.

16 Claims, 4 Drawing Figures

SPOOL TRANSPORTING DEVICE

The invention relates to a spool transporting device for the sequential transfer of textile spools to a spool receiving device, the spools being wound on tubes and disposed on a support surface of a predetermined spool preparation station in preparation for transport. The spool receiving device may be a spool magazine, a creel, a creel carriage, or the like.

If the prepared textile spools always have the same dimensions, especially the same diameter, the spool transporting device always remains in the same spool receiving position with respect to the spool preparation station. However, circumstances are different if when changing spools, spools with different diameters are to be transported. In this case, the spool receiving position must be adjusted each time for the spatial position of the longitudinal axis of the spool which is to be transported. During an automatic operation of the spool transporting device, this requires a considerable complexity of devices for aligning the spool which is to be transported. Furthermore, the alignment procedure also requires a certain amount of time. These disadvantages are especially annoying if the diameters of the spools to be transported are different from spool to spool.

It is accordingly an object of the invention to provide a spool transporting device which overcomes the hereinafore-mentioned disadvantages of the heretofore-known devices of this general type, and to permit the automatic operation of a spool transporting device in a simple manner, even if the diameter of the textile spools lying in a prepared state on the support of the spool preparation station varies considerably.

With the foregoing and other objects in view there is provided, in accordance with the invention, a spool transporting assembly for the sequential transfer of textile spools wound on tubes, comprising a predetermined spool preparation station having a support surface for supporting textile spools in preparation for transport, a spool receiving device, and a spool transporting device for transporting textile spools from the spool preparation station to the spool receiving device, the spool transporting including a gripper head being movable in at least one plane into and out of a centered spool receiving position being always fixed relative to the spool preparation station, the gripper head including gripper elements for gripping textile spools of different diameters in the centered spool receiving position.

Through the use of this structure, the alignment operation of the spool transporting device to the centered position or to the longitudinal axis of the textile spool to be transported, is omitted. At least two gripper elements must be provided for this purpose. At least one of these gripper elements must be movably supported with respect to the other gripper element. At least one gripper element must be approximately at the height of the support in the spool receiving position, and the combined action of the gripper elements must have the effect of picking up the textile spool from the support surface. For example, shovel-shaped grippers which can slide closely above the support surface would be capable of lifting spools with different diameters from the support surface and holding them. This would suffice for transporting the textile spool which has been picked up to a spool receiving device, and for depositing it there onto a support surface, by opening the gripper elements.

However, spool receiving devices are constructed in many diverse forms. For example, the spools may lie on support surface or in dishes, but the tubes of the spools can also be pushed onto pins. When pins are used for the tubes, it is necessary to align the spool transporting device with the receiving pin of the spool receiving device during the spool transfer. For this reason, it is practical to pre-align the textile spool in the gripper head with the central axis, that is to align it with the longitudinal axis of the gripper head, so that spool receiving devices with receiving pins can also be supplied with textile spools without difficulty. For this purpose, it is only necessary to align the longitudinal axis of the receiving pin with the longitudinal axis of the gripper head. Therefore, in accordance with another feature of the invention, the gripper head has a given longitudinal axis, the gripper elements are in the form of at least three gripper arms aligned parallel to the surface of the textile spools, the gripper arms being movable toward the longitudinal axis into a minimally open position and away from the longitudinal axis into a maximally open position, and the gripper head being movable into the spool receiving position relative to the spool preparation station wherein at least one of the gripper arms is disposed in the maximally open position substantially at the height of the support surface adjacent one of the textile spools.

Preferably, the gripper arms are disposed in such a way that one gripper arm is spaced at equal distances from its adjacent gripper arms. Three gripper arms, working in conjunction, guarantee a secure holding of the textile spool during the transfer operation. However, if the distance between adjacent gripper arms is greater than the diameter of the smallest textile spool to be transported, it is better to provide at least four gripper arms. The gripper arms start their operation from their maximally open position. The greater the number of gripper arms that are provided, the smaller the possibility that a spool with a small diameter will be laterally out of the range of the gripper head.

The gripper head may already be in the spool accepting position before the textile spool reaches the spool preparation station. However, as a rule, this is not the case. Normally, when the spool is positioned at the spool preparation station, the gripper head has to be moved to its spool accepting position. This is effected by axially sliding the gripper head in the direction toward the spool preparation station. In order to avoid problems during this operation, in accordance with a further feature of the invention, the support surface of the spool preparation station is inclined in direction of spool transfer toward the spool receiving device and laterally, and the support surface is disposed in a first plane, and including at least one guide element disposed in a second plane intersecting the first plane along a line for preventing the spools from rolling off the support surface laterally, one of said gripper arms being disposed substantially at the intersection line in the maximally open position.

Accordingly, in the maximum open position, that is, in the spool accepting position of the gripper head, one gripper arm is positioned in a wedge-shaped region formed by the spool surface, the plane of the bottom support and the plane in which one or more guide elements are disposed.

In accordance with an added feature of the invention, the support surface is in the form of a roller conveyor for receiving spools from a horizontal spool transport belt and for storing at least two of the spools one behind the other. In a manner of speaking, the roller conveyor forms a buffer storage device, so that the spool transport belt can also supply textile spools at irregular intervals.

As a rule, the spool transport belt is guided in a horizontal direction. In order to avoid an abrupt transition between a laterally inclined roller conveyor and the horizontal spool transport belt, in accordance with an additional feature of the invention, the roller conveyor gradually changes from a substantially horizontal input end to an inclined output end along the length thereof. The abovementioned guide element can be formed of one or more rods, or of a sheetmetal plate, or the like. However, it is also advantageous if, in accordance with again another feature of the invention, the guide element is also in the form of a roller conveyor. The roller tracks of the support surface and of the guide elements can be similarly constructed. Both can have the same inclination, so that they form a V-shaped support.

It was already mentioned above that the gripper arms are aligned parallel to the spool surface. The spool surface can by cylindrical or conical. In order to ensure that the gripper arms are able to move uniformly in the direction of the longitudinal axis of the gripper head, in accordance with again a further feature of the invention, there are provided pairs of parallel links, each pair being connected to a respective one of the gripper arms.

The uniform motion of the links, and accordingly the uniform motion of the gripper arms as well, is ensured if, in accordance with again an added feature of the invention, there are provided projections each being integral with one link of each respective pair of links and each protruding toward the longitudinal axis of the gripper head, and a common controllable pressure element in contact with all of the projections.

This pressure element may act in the direction of the longitudinal axis of the gripper head. In accordance with again an additional feature of the invention, the pressure element is a pneumatic or hydraulic pressure cylinder.

In order to permit the gripper head to move into the spool accepting position even if a textile spool is already positioned at its spool preparation station, in accordance with yet another feature of the invention, the spool transporting device includes a carriage on which the gripper head is slideable.

In order to ensure that the gripper head is capable of changing its orientation with respect to the horizontal plane, and therefore is capable of changing its position laterally, in accordance with yet a further feature of the invention, the carriage includes a pivot shaft or a carriage guide with a pivot shaft extended perpendicular to the direction of motion of the gripper head on the carriage.

In accordance with a concomitant feature of the invention, there is provided a vertically movable sliding carriage on which the pivot shaft is disposed. The vertically movable carriage performs the function of facilitating the spool transfer to the spool receiving device. In this case, the transfer of the spools need not be performed at a fixed place or at a fixed height above the floor. By adjusting the height, it becomes possible to transfer the textile spools to the spool receiving device at any chosen plane.

Other features which are considered as characteristic for the invention are set forth in the appended claims.

Although the invention is illustrated and described herein as embodied in a spool transporting device, it is nevertheless not intended to be limited to the details shown, since various modifications and structural changes may be made therein without departing from the spirit and scope of the invention and within the scope and range of equivalents of the claim.

The construction and method of operation of the invention, however. together with additional objects and advantages thereof will be best understood from the following description of specific embodiments when read in connection with the accompanying drawings, in which.

Figure 1:
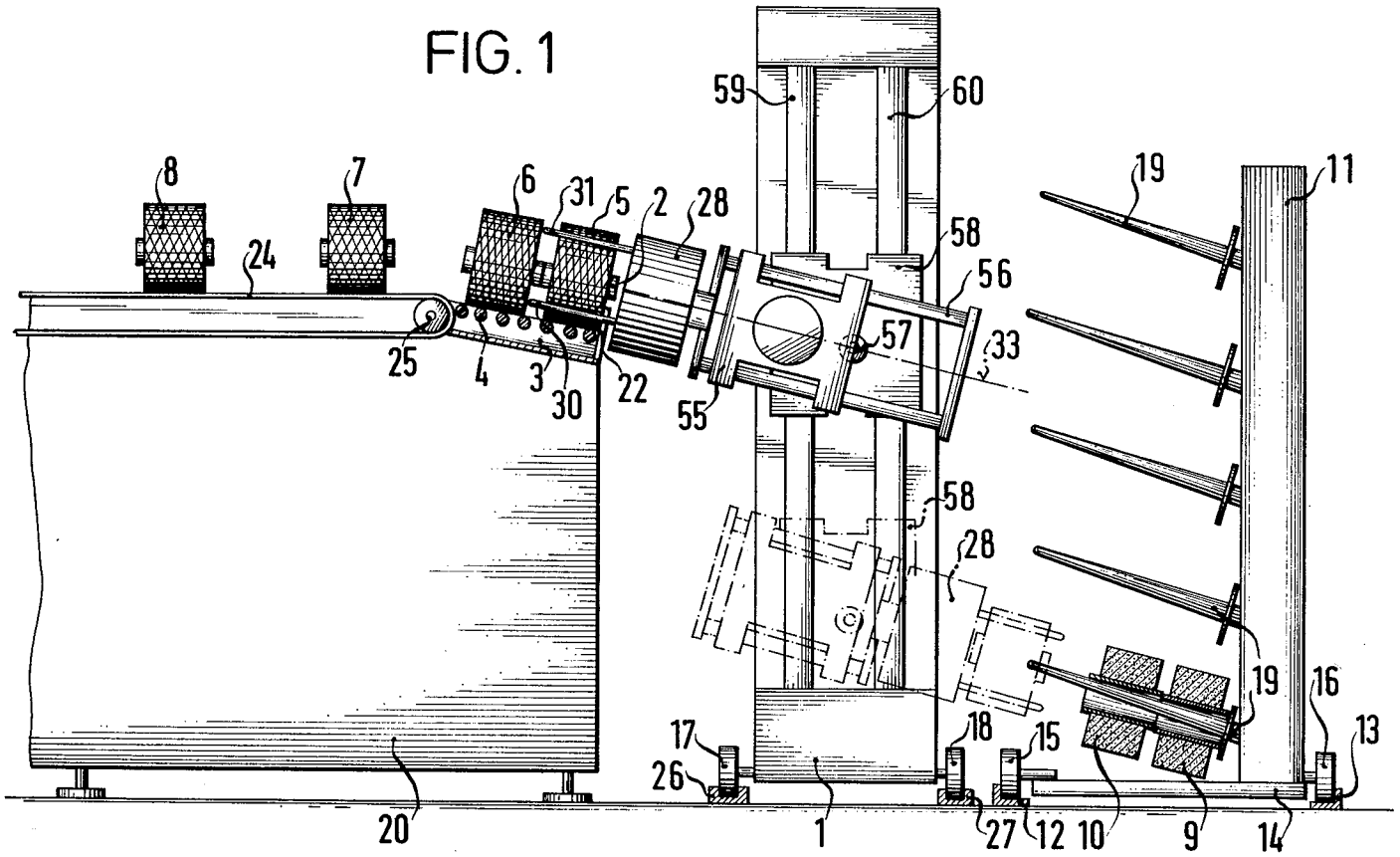
FIG. 1 is a fragmentary, diagrammatic, side-elevational view of a spool transporting device according to the invention.

Referring to the figures of the drawings and first particularly to FIG. 1 thereof, there is seen a spool transporting device 1 which serves for sequentially feeding textile bobbins or spools 5, 6 to a spool receiving device 11. The spools 5, 6 are wound on bobbin tubes 2 and are kept ready while positioned on a bottom support 4 at a particular spool preparation station 3.

The spool receiving device 11 is movably disposed on rails 12, 13, and for this purpose is provided with a carriage 14 and rollers 15, 16. The spool receiving device 11 is constructed in the form of a spool magazine, and is provided with several spool receiving pins 19 disposed in 5 levels on top of each other.

Figure 4:
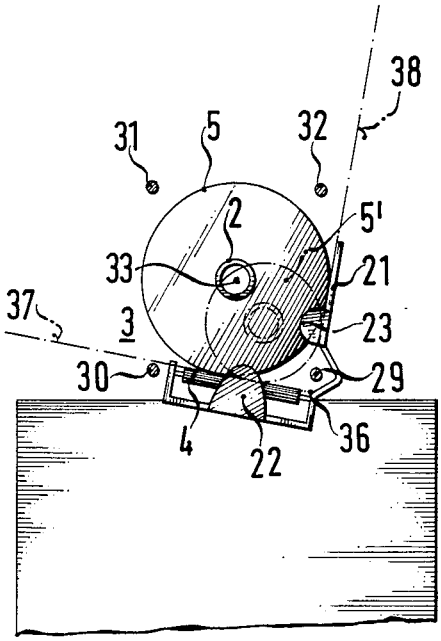
FIG. 4 is a fragmentary front-elevational view of a spool preparation station.

The spool preparation station 3 is disposed at the end of an open end spinning machine 20. The support 4 of the spool preparation station 3 is in the form of a roller conveyor. FIG. 1 shows that this roller conveyor 4 is inclined forward, in the feeding direction of the spools. FIG. 4 shows that the roller conveyor is also inclined toward the side. A guide element 21 is provided at the side of the support or roller conveyor 4, which prevents the textile spool from rolling off to the side. The guide element 21 is in the form of a sheet metal wall. In order to prevent the textile spool 5 in front from sliding off away from the spool preparation station 3, a stop 22 is provided at the end of the support 4, and a stop 23 is provided at the end of the guide element 21.

The roller conveyor 4 gradually changes from a horizontal to a laterally inclined position from its beginning to its end position. The roller conveyor is supplied with bobbins from a horizontally-guided spool transport belt 24. The spool transport belt 24 is guided over a deflection roller 25, and is part of the open-end spinning machine 20. In the open-end spinning machine 20 the textile spools which are made from spun threads are continuously deposited onto the spool transport belt 24. However, this happens irregularly, and only the spool preparation station 3 ensures the fact that one or two textile spools are ready to be transported further on. If the spool transport belt delivers more textile spools than can be transported further, it is possible to stop the spool transport belt in the interim.

The spool transporting device 1 is disposed on rails 26, 27 so that it can be moved. It may be moved on these rails to adjacently positioned open-end spinning machines, and it may also be rolled to more distant spool receiving devices 11. The entire operation of the spool transporting device 1, including its travel along the rails 26 and 27, can be effected fully automatically.

The spool transporting device 1 is provided with a movable gripper heas 28. The gripper head can change its position in the plane perpendicular to its longitudinal axis 33 when the spool transporting device 1 is standing still. With respect to the spool preparation station 3, the gripper head 28 always is in the same spool accepting position as shown in FIG. 1. The gripper head 28 is provided with four gripper elements 29 to 32 shown in FIGS. 2 to 4. The gripper elements are made in the form of gripper arms. The gripper elements or gripper arms 29 to 32 are disposed in such a way that the gripper head 28 can grab textile spools 5, 5', respectively, shown in FIG. 4, which have different diameters, while maintaining its central position (with respect to its longitudinal axis 33).

Figure 3:
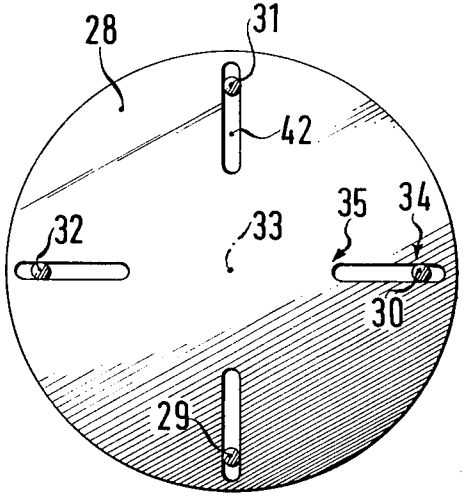
FIG. 3 is a front-elevational view of the gripper head shown in FIG. 2.
Figure 2:
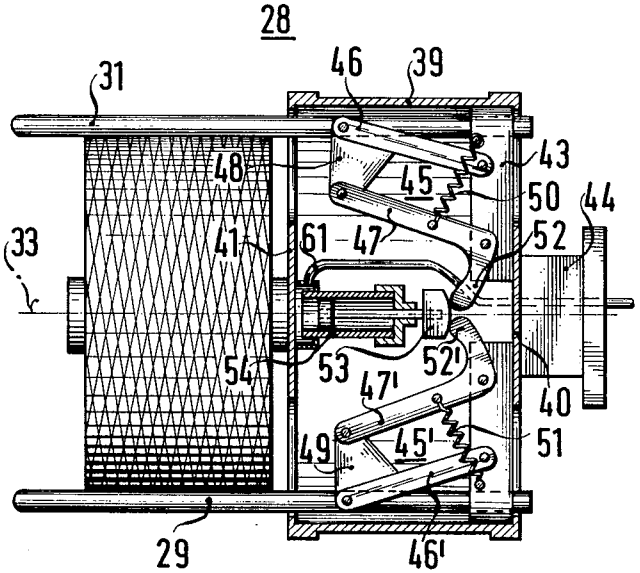
FIG. 2 is a top plan view of the interior of the gripper head of the device according to FIG. 1.

The textile spools are in the form of cylindrical spools. The gripper arms are aligned parallel to the spool surface, so that all four are mutually parallel. FIG. 2 and FIG. 3 indicate that the gripper arms 29 to 32 slide in opposite directions from a maximally open position 34 to a minimally open position 35 toward the longitudinal axis 33 of the gripper head 28. FIG. 4 shows that the gripper head 28 is disposed with respect to the spool preparation station 3 in such a way that at least the gripper arms 29 and 30 are approximately at the height or level of the support 4, and are positioned adjacent the textile spool 5, 5', respectively. The textile spool 5 represents a spool with a maximum diameter and the textile spool 5' represents a spool with a minimum diameter. As shown in FIG. 4, the gripper arm 29 is positioned somewhat above the intersection line of a plane 37 and a point 36, the support 4 being disposed in the plane 37. The gripper arm 29 also lies in a second plane 38 in which the guide element 21 is disposed.

FIG. 2 shows that the gripper head 28 is provided with a housing 39. The housing 39 is closed by a cover 40 in the back and a cover 41 in the front thereof. Both covers have slots 42 formed therein permitting the gripper arms to pass through, and in some cases serving as guides for the gripper arms 29 to 32. In the interior of the housing, a four-armed spider or holder 43 is connected to a holding foot 44 which is coaxial with the longitudinal axis 33. A pair of parallel links is mounted to each of the four arms of the spider 43. FIG. 2 shows the pairs of parallel links 45 and 45' of these four pairs. The pair of parallel links 45 is formed of the links 46 and 47 while the pair of parallel links 45' is formed of the links 46' and 47'. The link 46 is articulatingly connected to the gripper arm 31 and the link 46' is articulatingly connected to the gripper arm 29, as shown in FIG. 2. The link 47 is articulatingly connected to a lug 48 of the gripper arm 31, the link 47' is articulatingly connected to a lug 49 of the gripper arm 29. A tension spring 50 pulls the pair of parallel links 45 outward and a tension spring 51 pulls the pair of parallel links 45' outward. Consequently, the gripper elements or gripper arms 29 to 32 are in the maximally open position 34 (shown in FIG. 3) in the rest state. The inner link of each respective linkage pair is provided with a projection. FIG. 2 shows the projection 52 of the link 47 and the projection 52' of the link 47'. All of the projections are directed toward the longitudinal axis 33 of the gripper head 28, and are in contact with a controllable pressure element 53. The pressure element 53 includes a fluidic cylinder 54.

According to FIG. 1, the gripper head 28 is fastened to a sliding carriage 55 by means of the holding foot 44. The carriage 55 is slideably supported in a carriage guide 56 in such a manner that the position of the gripper head 28 can be changed along its longitudinal axis 33. The carriage guide 56 is provided with a swivel shaft 57 which is oriented perpendicularly to the direction of motion of the gripper head 28. The swivel shaft 57 is disposed on an additional carriage 58 which can slide vertically. The carriage 58 moves along vertical guide rails 59 and 60.

During the operation of the open-end spinning machine 20, the spool transporting belt 24 delivers textile spools 7, 8 in an irregular sequence. The textile spools roll in the direction of their tubes, i.e. in the longitudinal direction, onto the roller conveyor 4. As soon as the roller conveyor 4 has received two textile spools, such as the spools 5 and 6 according to FIG. 1, a signal is given to the spool transporting belt 24 that additional textile spools cannot be accepted. The spool transporting belt 24 is stopped in this way.

The spool transporting device 1 is moved in on the rails 26 and 27 for removing the textile spools from an open-end spinning machine 20 and for loading the spool receiving device 11. This can be effected fully automatically. In order to place the spool transporting device 1 into position, a stop can be provided for the device 1 at the head end of the open-end spinning machine 20. The height of the sliding carriage 58 above the rails 26 and 27 is determined by the corresponding height of the spool preparation station 3. The position of the carriage 58 at the point in time when the spools are received is thereby fixed once and for all. For receiving the spools, the carriage 55 is first moved automatically to the most retracted position, i.e. according to FIG. 1, it is moved all the way to the right. The carriage 55 automatically moves forward into the forward position, i.e. all the way to the left as shown in FIG. 1. The four gripper arms 29 to 32 thus grip the farthest forward textile spool 5, or 5' respectively, lying in readiness on the roller conveyor 4, as shown in FIG. 4. The special position of the four gripper arms 29 to 32 is also fixed once and for all. In the case of the embodiment at hand, the illustrated condition is that the gripper arm 29 is approximately at the position of the intersection line of the planes 37 and 38, as shown in FIG. 4. In this way, a sufficiently large wedge-shaped region is formed, which cannot be filled, by either a large or a small spool.

The actual transporting of the spool is initiated by the operation of the pressure cylinder 54. The cylinder 54 is supplied with compressed air through a line 61, so that all four gripper arms 29 to 32 move in the direction toward the longitudinal axis 33 of the gripper head 28, until they are in solid contact with the surface of the spool.

When the gripper head 28 has the textile spool 5 securely held in a position in which it is aligned with the longitudinal axis 33, two movements can take place at the same time. The carriage guide 56 can be rotated clockwise about the pivot axis 57, and at the same time the carriage 55 can move back into the retracted position. The backward motion is necessary in order to ensure that the gripped textile spool does not become hung up or interfere with one of the spool receiving pins 19 of the spool receiving device 11 when the carriage guide 56 is rotated 180 degrees. In practice, the spool receiving device 11 is positioned in such a way that a whole row of spool receiving pins 19 are positioned and aligned vertically on top of each other with the longitudinal axis 33 of the gripper head 28.

In order to transfer the gripped textile spool 5 to any of the pins 19 positioned in line, it is only necessary to align the longitudinal axis 33 of the gripper head 28 with the respective spool receiving pin. In the embodiment used as an example, the spool receiving pins 19 have approximately the same inclination as the roller conveyor 4 or as the longitudinal axis 33. This simplifies the spool transfer somewhat, because the carriage 28 need only be placed into one of the pre-programmed height positions for the transfer, which corresponds to the height position of the individual pin levels.

As indicated in phantom in FIG. 1, the carriage 58 is positioned in front of the lowest spool receiving pin in such a way that this pin is aligned with the longitudinal axis of the gripper head 28. The actual spool transfer is made in such a way that the carriage 55 first moves all the way forward and then the compressed air acting on the air cylinder 54 is reversed. The lower spool receiving pin 19 therefore enters the tube 2 of the spool, and the gripper head 28 releases the textile spool 5.

Each spool receiving pin 19 can accept three textile spools. The first transferred textile spool, for example the spool 9 according to FIG. 1, does not have to slide immediately down to the foot of the receiving pin 19. It can be pushed further down by the second textile spool 10 which is received. In turn, this spool can be pushed further by the third textile spool.

The foregoing is a description corresponding in substance to German Application P 32 44 925.9, filed Dec. 4, 1982, the International priority of which is being claimed for the instant application, and which is hereby made part of this application. Any material discrepancies between the foregoing specification and the aforementioned corresponding German application are to be resolved in favor of the latter.

We claim:

1. Spool transporting assembly for the sequential transfer of textile spools wound on tubes, comprising a spool preparation station having a support surface for textile spools, a spool receiving device, and a spool transporting device for transporting textile spools from said spool preparation station to said spool receiving device, said spool transporting device including a gripper head being movable in at least one plane into and out of a centered spool receiving position being fixed relative to said spool preparation station, said gripper head including gripper elements for gripping textile spools of different diameters in said centered spool receiving position, said gripper head having a given longitudinal axis, said gripper elements being in the form of at least three gripper arms aligned parallel to the surface of the textile spools, said gripper arms being movable toward the longitudinal axis into a minimally open position and away from the longitudinal axis into a maximally open position, and said gripper head being movable into said spool receiving position relative to said spool preparation station wherein at least one of said gripper arms is disposed in said maximally open position substantially at the height of said support surface adjacent one of the textile spools.

2. Spool transporting assembly according to claim 1, wherein said support surface of said spool preparation station is inclined in direction of spool transfer toward the spool receiving device and laterally, and said support surface is disposed in a first plane, and including at least one guide element disposed in a second plane intersecting said first plane along a line for preventing the spools from rolling off said support surface laterally, one of said gripper arms being disposed substantially at said intersection line in said maximally open position.

3. Spool transporting assembly according to claim 1, wherein said support surface is in the form of a roller conveyor for receiving spools from a horizontal spool transport belt and for storing at least two of the spools one behind the other.

4. Spool transporting assembly according to claim 2, wherein said support surface is in the form of a roller conveyor for receiving spools from a horizontal spool transport belt and for storing at least two of the spools one behind the other.

5. Spool transporting assembly according to claim 3, wherein said roller conveyor gradually changes from a substantially horizontal input end to an inclined output end along the length thereof.

6. Spool transporting assembly according to claim 2, wherein said guide element is in the form of a roller conveyor.

7. Spool transporting assembly according to claim 4, wherein said guide element is also in the form of a roller conveyor.

8. Spool transporting assembly according to claim 1, including pairs of parallel links, each pair being connected to a respective one of said gripper arms.

9. Spool transporting assembly according to claim 8, including projections each being integral with one link of each respective pair of links and each protruding toward the longitudinal axis of said gripper head, and a common controllable pressure element in contact with all of said projections.

10. Spool transporting assembly according to claim 9, wherein said pressure element is a pneumatic pressure cylinder.

11. Spool transporting assembly according to claim 9, wherein said pressure element is a hydraulic pressure cylinder.

12. Spool transporting assembly according to claim 1, wherein said spool transporting device includes a carriage on which said gripper head is slidable.

13. Spool transporting assembly according to claim 12, wherein said carriage includes a pivot shaft extended perpendicular to the direction of motion of said gripper head on said carriage.

14. Spool transporting assembly according to claim 12, wherein said carriage includes a carriage guide with a pivot shaft extended perpendicular to the direction of motion of said gripper head on said carriage.

15. Spool transporting assembly according to claim 13, including a vertically movable sliding carriage on which said pivot shaft is disposed.

16. Spool transporting assembly according to claim 14, including a vertically movable sliding carriage on which said pivot shaft is disposed.

* * * * *